US005518043A

United States Patent [19]

Cheung et al.

[11] Patent Number: 5,518,043

[45] Date of Patent: May 21, 1996

[54] READILY ASSEMBLED AND DISASSEMBLED, MODULAR, PNEUMATICALLY POWERED STRAPPING TOOL

[75] Inventors: Nelson Cheung, Hoffman Estates; Janusz Figiel, Mount Prospect; Allen D. Sordyl, Wheeling, all of Ill.

[73] Assignee: Illinois Tool Works, Glenview, Ill.

[21] Appl. No.: 370,533

[22] Filed: Jan. 9, 1995

[51] Int. Cl.[6] ..... B21F 9/02

[52] U.S. Cl. ..... 140/93.2; 140/152

[58] Field of Search ..... 140/93.2, 93.4, 140/152

[56] References Cited

U.S. PATENT DOCUMENTS

| | | | |
|---|---|---|---|
| 3,211,186 | 10/1965 | Bushman | 140/93.4 |
| 3,319,666 | 5/1967 | Langford et al. | 140/93.2 |
| 4,825,512 | 5/1989 | Tremper et al. | 24/20 EE |
| 5,136,888 | 8/1992 | Nix | 74/88 |

*Primary Examiner*—Lowell A. Larson

*Attorney, Agent, or Firm*—Thomas W. Buckman; Donald J. Breh; John P. O'Brien

[57] ABSTRACT

A pneumatically powered strapping tool, being modular, comprises a tensioning motor module, a sealing motor module, a sealing mechanism module, and a control valve module. The tensioning motor module comprises a pneumatic tensioning motor arranged to coact with a tensioning mechanism driven by such motor for tensioning two overlapped ends of a steel strap drawn from a supply and wrapped around a load. The sealing motor module comprises a pneumatic sealing motor, which is arranged to drive the sealing mechanism module for sealing the overlapped ends to each other, after the overlapped ends have been tensioned. The control valve module comprises pneumatic control valves for controlling the respective pneumatic motors. The modules and the tensioning means are adapted to be readily assembled and to be readily disassembled without requiring disassembly of any of the modules.

3 Claims, 3 Drawing Sheets

READILY ASSEMBLED AND DISASSEMBLED, MODULAR, PNEUMATICALLY POWERED STRAPPING TOOL

TECHNICAL FIELD OF THE INVENTION

This invention pertains to a pneumatically powered strapping tool, which is improved by being modular, whereby the tool can be readily assembled and disassembled.

Background of the Invention

Strapping tools of a type in widespread use are designed to tension the overlapped ends of a steel strap drawn from a supply and wrapped around a load, to punch interlockable shoulders into the overlapped ends of the steel strap, to cut one of the overlapped ends from any steel strap remaining in the supply, and to release the overlapped ends, so as to form a tensioned loop of the steel strap around the load. A steel strap having interlockable shoulders punched into its overlapped ends, as by a strapping tool of the type noted above, is exemplified in Tremper et al. U.S. Pat. No. 4,825,512.

Although as exemplified in Nix U.S. Pat. No. 5,136,888 many strapping tools of the type noted above are lever-actuated tools without pneumatic, electrical, or other motors, it is known for such strapping tools to be pneumatically powered and to have separate pneumatic motors controlled by manually controlled valves respectively for tensioning and for punching and cutting.

As known heretofore, such a pneumatically powered strapping tool comprises very many elements, which are very difficult and time-consuming to assemble for assembly of the tool and to disassemble for servicing of the tool. Therefore, it would be highly desirable to provide a modular tool, which could be readily assembled and disassembled.

A pneumatic motor useful in such a pneumatically powered strapping tool is disclosed in a copending U.S. patent application, Ser. No. 08/241,343, which was filed on May 11, 1994, which is assigned commonly herewith, and the disclosure of which is incorporated herein by reference.

A pneumatic control circuit for such a pneumatically powered strapping tool is disclosed in a copending U.S. patent application, Ser. No. 08/283,546, which was filed on Aug. 1, 1994, now U.S. Pat. No. 5,428,959, which is assigned commonly herewith, and the disclosure of which is incorporated herein by reference.

SUMMARY OF THE INVENTION

This invention provides an improvement in a pneumatically powered strapping tool of the type noted above, which comprises a tensioning means, a sealing means, and a controlling means. Being modular, the improved tool can be readily assembled and disassembled.

Typically, in such a pneumatically powered strapping tool, the tensioning means comprises a pneumatic tensioning motor and a tensioning mechanism driven by the tensioning motor for tensioning two overlapped ends of a steel strap drawn from a supply and wrapped around a load. Typically, moreover, the sealing means comprises a pneumatic sealing motor and a sealing mechanism driven by the pneumatic sealing motor for sealing the overlapped ends to each other, after the overlapped ends have been tensioned, by punching interlockable shoulders into the overlapped ends, cutting one of the overlapped ends from any steel strap remaining in the supply, and releasing the overlapped ends, so as to form a tensioned loop of the steel strap around the load. Typically, furthermore, the controlling means comprises pneumatic control valves for controlling the respective pneumatic motors.

In an improved tool according to this invention, the strapping tool comprises a tensioning motor module comprising the pneumatic tensioning motor, a sealing motor module comprising the pneumatic sealing motor, a sealing mechanism comprising the sealing mechanism, and a control valve module comprising the pneumatic control valves. Moreover, the modules and the tensioning mechanism are adapted to be readily assembled and to be readily disassembled without requiring disassembly of any of the modules.

Preferably, the respective modules and the tensioning mechanism are adapted to be so assembled that the control valve module must be disassembled from the sealing motor module and from the tensioning motor module before the sealing motor module, the tensioning motor module, and the sealing mechanism module can be disassembled from one another and from the tensioning mechanism. Preferably, moreover, the sealing motor module is adapted to be removed from the sealing mechanism module, after the control valve module has been disassembled from the sealing motor module and from the tensioning motor module, without requiring further disassembly.

These and other objects, features, and advantages of this invention are evident from the following description of a preferred embodiment of this invention with reference to the accompanying drawings.

DETAILED DESCRIPTION OF THE PREFERRED EMBODIMENT

Figure 1:
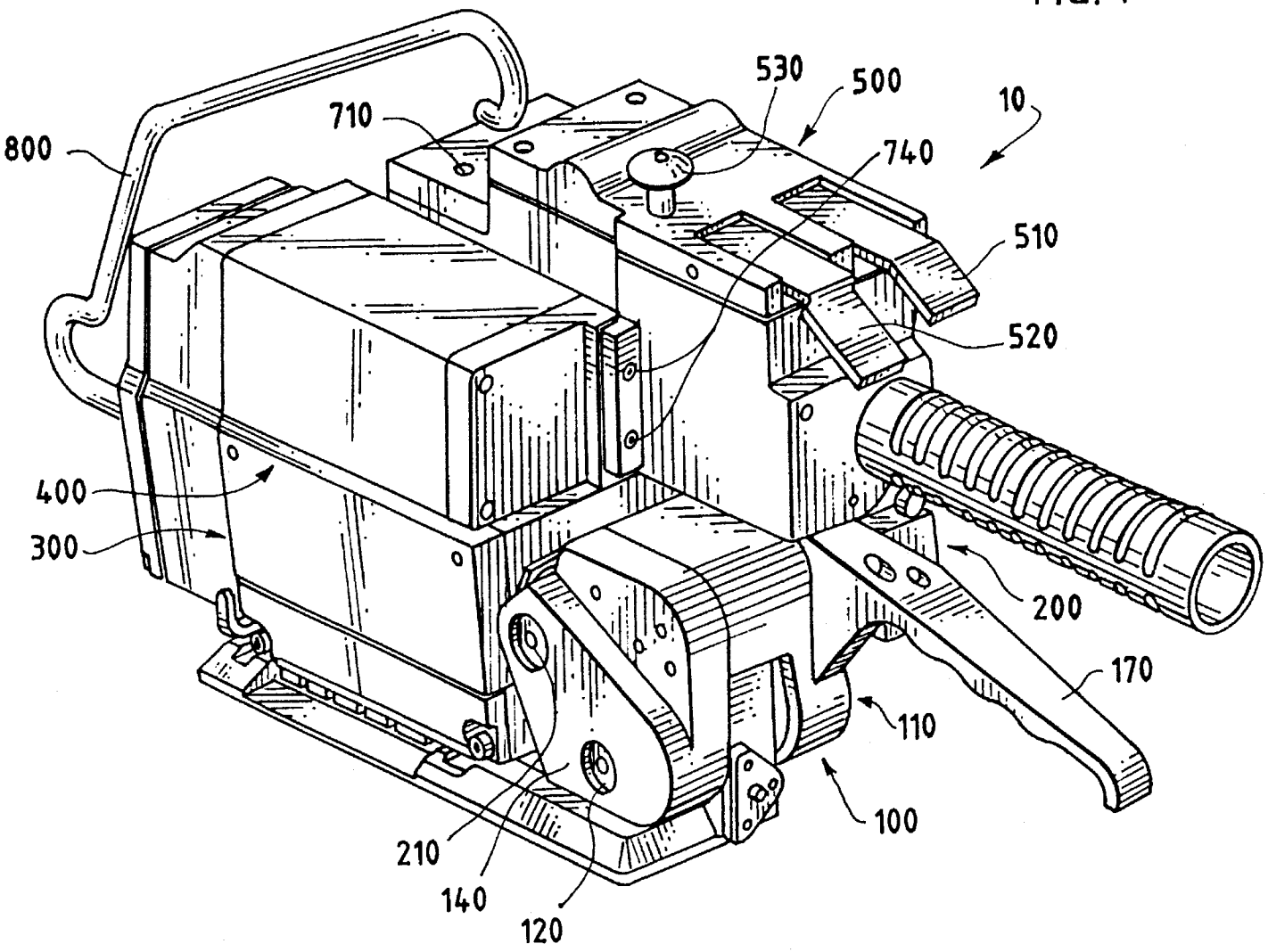
FIG. 1 is a perspective view of an assembled, modular, pneumatically powered strapping tool constituting a preferred embodiment of this invention.
Figure 2:
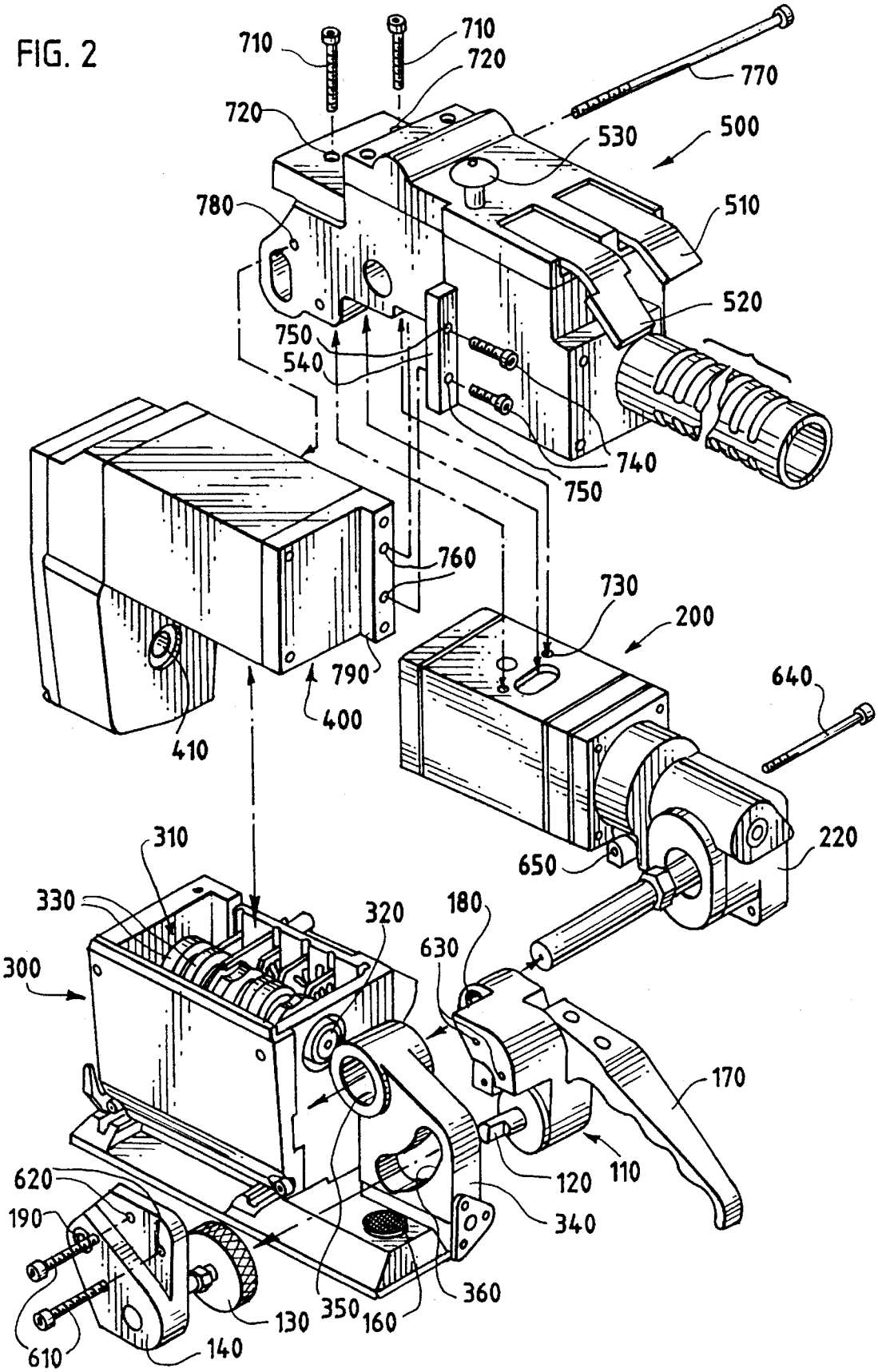
FIG. 2 is an exploded, partly broken away, perspective view of the same tool, as disassembled into various modules and machine screws.

As shown in the drawings, a pneumatically powered strapping tool 10 constitutes a preferred embodiment of this invention. Being modular, the strapping tool 10 can be readily assembled from various modules and other elements, as described below. Moreover, the strapping tool 10 can be readily disassembled, as for servicing.

Generally, the assembled tool 10 is operable in a known manner to tension the overlapped ends of a steel strap drawn from a supply and wrapped around a load, to punch interlockable shoulders into the overlapped ends of the steel strap, to cut one of the overlapped ends from any steel strap remaining in the supply, and to release the overlapped ends, so as to form a tensioned loop of the steel strap around the load. The strap, supply, and load are not shown.

Principally, the strapping tool 10 comprises a tensioning mechanism 100, a tensioning motor module 200, a sealing mechanism module 300, a sealing motor module 400, and a control valve module 500. The tensioning mechanism 100 and the respective modules 200, 300, 400, 500, are adapted to be readily assembled for assembly of the strapping tool 10 and to be readily disassembled for disassembly of the strapping tool 10.

In the assembled tool 10, the tensioning mechanism 100 is driven by the tensioning motor module 200 and is adapted to coact with the sealing mechanism module 300 so as to tension the overlapped ends of the steel strap. Moreover, the sealing mechanism module 300 is driven by the sealing motor module 400 so as to punch interlockable shoulders into the overlapped ends of the steel strap, and to cut one of the overlapped ends from any steel strap remaining in the supply, and to release the overlapped ends, so as to form a tensioned loop of the steel strap around the load. The tensioning motor module 200 and the sealing motor module 400 are controlled by the control valve module 500.

The tensioning mechanism 100 comprises a tensioning gear drive 110, which is arranged to be rotatably driven by the tensioning motor module 200, and a shaft 120, which is arranged to be rotatably driven when such drive 110 is driven. The tensioning mechanism 100 further comprises a knurled tensioning wheel 130, which is mounted on the shaft 120 so as to be conjointly rotatable with the shaft 120, and a cover 140, which in the assembled tool 10 is mounted to the sealing mechanism module 300 so as to cover all but lower portions of the wheel 130.

The tensioning motor module 200 comprises a pneumatic tensioning motor (not shown) which preferably conforms to the pneumatic motor disclosed in Ser. No. 08/241,343, supra, the disclosure of which is incorporated herein by reference. The tensioning motor module 200 further comprises a shaft 210 and a gear drive 220. The shaft 210 is arranged to be rotatably driven, via the gear drive 220, when the pneumatic tensioning motor is powered pneumatically. The tensioning mechanism 100 further comprises a lever 170, which extends from the tensioning gear drive 110, and which in the assembled tool 10 enables such drive 110 to be manually pivoted on the shaft 210 so as to move the knurled tensioning wheel 130 toward and away from a knurled tensioning pad 160 mounted fixedly on the sealing mechanism module 300. The tensioning gear drive 110 has a bearing assembly 180 to journal the shaft 210. The cover 140 has a bearing assembly 190 to journal the same shaft 210.

In the assembled tool 10, when tensioning gear drive 110 is pivoted so as to move the knurled tensioning wheel 130 toward the knurled tensioning pad 160 and the tensioning mechanism 100 is driven by the tensioning motor module 200, the knurled tensioning wheel 130 coacts with the knurled tensioning pad 160 to draw an upper one of two overlapped ends of a steel strap over the lower one of the overlapped ends, while the lower end is held frictionally by the knurled tensioning pad 160, so as to tension the overlapped ends.

The sealing mechanism module 300 comprises a cam-driven mechanism 310 comprising a shaft 320 mounting cams 330, which are arranged to rotate conjointly with the shaft 320 and to drive punches (not shown) into dies (not shown) when the shaft 320 is driven rotatably, so as to punch interlockable shoulders into the overlapped ends of the steel strap, and to cut one of the overlapped ends from any steel strap remaining in the supply, and to release the overlapped ends, so as to form a tensioned loop of the steel strap around the load. The sealing mechanism module 300 has an outer bracket 340 comprising a aperture 350 to accommodate the shaft 210 of the tensioning motor module 200 as the shaft 210 is driven rotatably and having an arcuate slot 360 to accommodate the shaft 120 of the tensioning gear drive 110 as such drive 110 is pivoted on the shaft 120.

The sealing motor module 400 comprises a pneumatic sealing motor (not shown) which preferably conforms to the pneumatic motor disclosed in Ser. No. 08/241,343, supra, the disclosure of which is incorporated herein by reference. The sealing motor module 400 has a driving socket 410, which in the assembled tool 10 receives a driven end (not shown) of the shaft 320 of the sealing mechanism module 300 for driving the shaft 320 rotatably from the pneumatic sealing motor of such module 400.

The control valve module 500 comprises a pneumatic control circuit, which comprises pneumatic control valves (not shown) and which preferably conforms to the pneumatic control circuit disclosed in Ser. No. 08/283,546, supra, the disclosure of which is incorporated herein by reference. Manually actuatable control levers 520, 530 are provided respectively for two such valves, which respectively control the pneumatic motors of the tensioning motor module 200 and the sealing motor module 400, as disclosed in Ser. No. 08/283,546. A manually actuatable control knob 530 is provided for another such valve, which functions as a shut-off valve, as disclosed in Ser. No. 08/283,546.

Except as illustrated and described herein, in Ser. No. 08/241,343, supra, and in Ser. No. 08/283,546, supra, further details of the tensioning mechanism 100 and the respective modules 200, 300, 400, 500, are outside the scope of this invention and can be readily supplied by persons having ordinary skill in the art.

When the strapping tool 10 is assembled, the tensioning mechanism 100 is assembled to the sealing mechanism module by passing the shaft 120 of the tensioning gear drive 110 through the arcuate slot 360 of the outer bracket 340 and by driving two machine screws 610 through respective unthreaded holes 620 in the cover 140, into respective threaded sockets 630 in the tensioning gear drive 110. Next, the tensioning motor module 200 is assembled to the tensioning mechanism 100 and to the sealing mechanism module 300 by passing the shaft 210 through the bearing assembly 180 of the tensioning gear drive 110, through the arcuate slot 360 of the outer bracket 340, and through the bearing assembly 190 of the cover 140 and by driving a machine screw 640 through an unthreaded hole 650 in the gear drive 220 of the tensioning motor module 200, into a threaded socket (not shown) in the sealing mechanism module 300.

Moreover, the sealing motor module 400 is seated on the sealing mechanism module 300 so that the driven end (not shown) of the shaft 320 of the sealing mechanism module 300 is received by the driving socket 410 of the sealing motor module 400. Thereupon, the sealing motor module 400 and the control valve module 500 are assembled to each other and to the tensioning motor module 200 by driving two machine screws 710 through respective unthreaded holes 720 in the control valve module 500, into respective threaded sockets 730 in the tensioning motor module 200, by driving two machine screws 740 through respective unthreaded apertures 750 in a flange 540 extending from the control valve module 500, into respective threaded sockets 760 an a flange 790 extending from the sealing motor module 400, and by driving a machine screw 770 through an unthreaded socket 780 (see FIG. 3) in the control valve module 500, into a threaded socket (not shown) in the sealing motor module 400.

Therefore, the control valve module 500 must be disassembled from the sealing motor module 400 and from the tensioning motor module 200 upon removal of the machine screw 710, 740, 770, before the sealing motor module 400, the tensioning motor module 200, and the sealing mechanism module 300 can be disassembled from one another and before the tensioning mechanism 100 can be disassembled from the sealing mechanism module 300.

After the control valve module 500 has been disassembled from the sealing motor module 400 and from the tensioning motor module 200, the sealing motor module 400 can be then unseated from the sealing mechanism module 300 without requiring further disassembly. The tensioning mechanism 100, the tensioning motor module 200, and the sealing mechanism module 300 can be readily disassembled from one another upon removal of the machine screws 610, 640.

Figure 3:
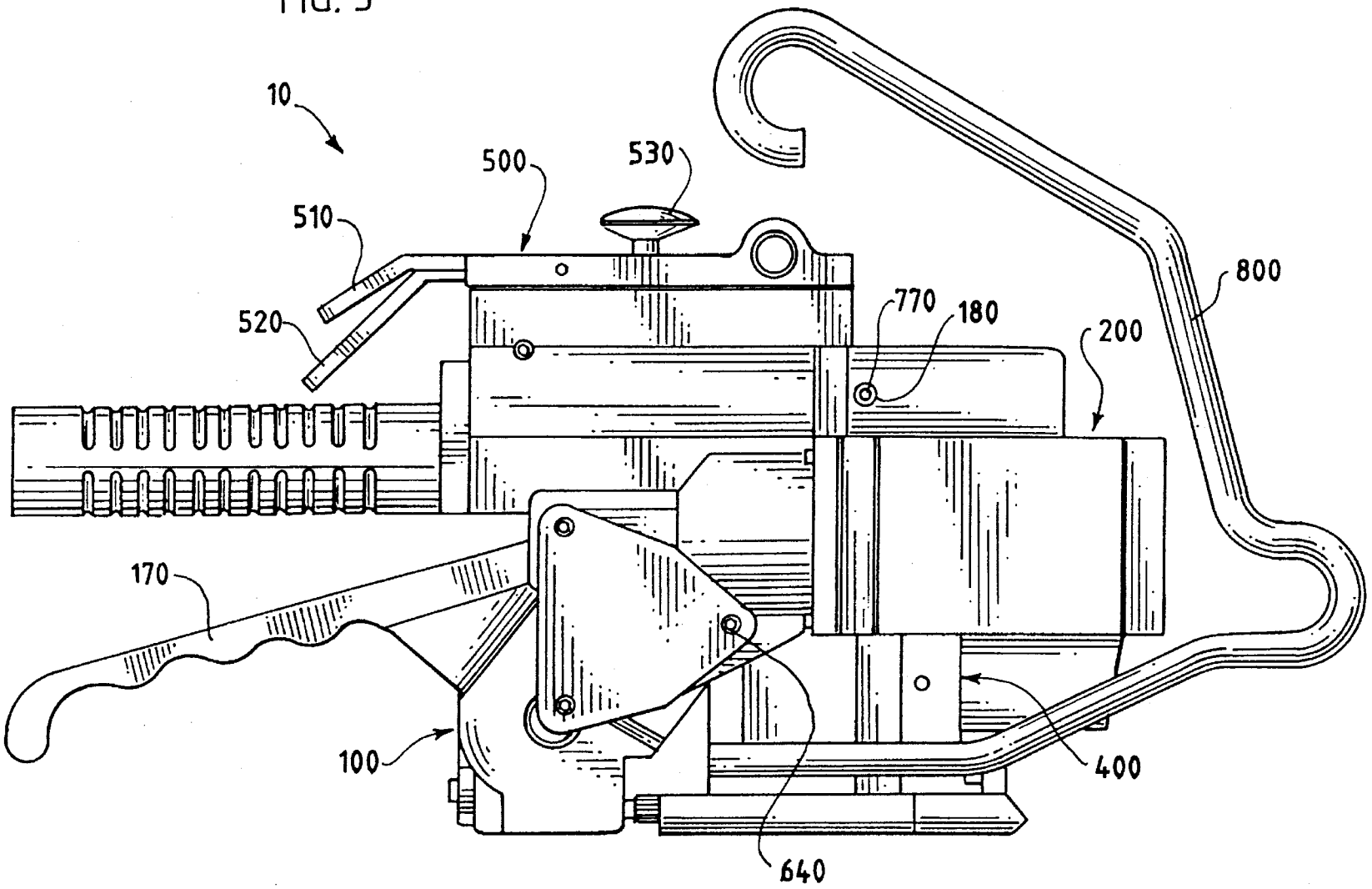
FIG. 3 is a side, elevational view of the same tool, as assembled.

As shown in FIGS. 1 and 3, the strapping tool 10 further comprises a carrying handle 800, which is attached suitably to the sealing mechanism module 300.

Various modifications may be made in the preferred embodiment described above without departing from the scope and spirit of this invention.

We claim:

1. In a pneumatically powered strapping tool of a type comprising (a) means comprising a pneumatic tensioning motor and a tensioning mechanism driven by the tensioning motor for tensioning two overlapped ends of a steel strap drawn from a supply and wrapped around a load, (b) means comprising a pneumatic sealing motor and a sealing mechanism driven by the pneumatic sealing motor for sealing the overlapped ends to each other, after the overlapped ends have been tensioned, by punching interlockable shoulders into the overlapped ends, cutting one of the overlapped ends from any steel strap remaining in the supply, and releasing the overlapped ends, so as to form a tensioned loop of the steel strap around the load, and (c) means comprising pneumatic control valves for controlling the respective pneumatic motors, an improvement wherein the strapping tool comprises a tensioning motor module comprising the pneumatic tensioning motor, a sealing motor module comprising the pneumatic sealing motor, a sealing mechanism module comprising the sealing mechanism, and a control valve module comprising the controlling means, and wherein the modules and the tensioning mechanism are adapted to be readily assembled for assembly of the strapping tool and to be readily disassembled for disassembly of the strapping tool without requiring disassembly of any of the modules.

2. The improvement of claim 1 wherein the respective modules and the tensioning mechanism are adapted to be so assembled that the control valve module must be disassembled from the sealing motor module and from the tensioning motor module before the sealing motor module, the tensioning motor module, and the sealing mechanism module can be disassembled from one another and from the tensioning mechanism.

3. The improvement of claim 2 wherein the sealing motor module is adapted to be removed from the sealing mechanism module, after the control valve module has been disassembled from the sealing motor module and from the tensioning motor module, without requiring further disassembly.

* * * * *